US009853402B2

(12) United States Patent
Talalayev et al.

(10) Patent No.: US 9,853,402 B2
(45) Date of Patent: Dec. 26, 2017

(54) INTERCONNECT DEVICES HAVING A BIPLANAR CONNECTION

(71) Applicant: Apple Inc., Cupertino, CA (US)

(72) Inventors: Anton Talalayev, San Jose, CA (US); David H. Narajowski, Los Gatos, CA (US); Christiaan A. Ligtenberg, San Carlos, CA (US); Mahmoud R. Amini, Sunnyvale, CA (US); William F. Leggett, San Jose, CA (US); Mikael M. Silvanto, San Francisco, CA (US); Christopher J. Stringer, Woodside, CA (US); George Tziviskos, Cupertino, CA (US); Edward Cooper, Campbell, CA (US); Ron Alan Hopkinson, Cupertino, CA (US); Ari Parsons Miller, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/151,288

(22) Filed: May 10, 2016

(65) Prior Publication Data

US 2017/0093099 A1 Mar. 30, 2017

Related U.S. Application Data

(60) Provisional application No. 62/235,514, filed on Sep. 30, 2015.

(51) Int. Cl.
*H01R 13/648* (2006.01)
*H01R 24/60* (2011.01)
(Continued)

(52) U.S. Cl.
CPC ..... *H01R 24/60* (2013.01); *H01R 12/7082* (2013.01); *H01R 13/6583* (2013.01)

(58) Field of Classification Search
CPC ..... H01R 24/60; H01R 13/6583; H01R 12/7082; H01R 13/65802; H01R 13/6596
(Continued)

(56) References Cited

U.S. PATENT DOCUMENTS 8,968,031 B2 * 3/2015 Simmel ..... H01R 13/659 439/108
9,640,925 B2 * 5/2017 Tsai ..... H01R 25/006
(Continued)

FOREIGN PATENT DOCUMENTS

CN 104810690 A 7/2015
CN 106558782 A 4/2017
(Continued)

OTHER PUBLICATIONS

Extended European Search Report for European Application No. EP16183823.0, dated Jul. 7, 2017 in 8 pages.

*Primary Examiner* — Hae Moon Hyeon
(74) *Attorney, Agent, or Firm* — Kilpatrick Townsend and Stockton, LLP

(57) ABSTRACT

An interconnect device can be aligned in a first plane and can include a printed circuit board having a tongue portion and a pin portion. The pin portion can include a plurality of pins extending away from the printed circuit board. The interconnect device can be configured to electrically couple with a main logic board aligned in a second plane. In particular, the plurality of pins can be inserted into corresponding electrical contact locations within the main logic board to form a biplanar connection. The biplanar connection can be made in way that minimizes signal loss for high speed data transfers.

21 Claims, 4 Drawing Sheets

(51) Int. Cl.
*H01R 13/6583* (2011.01)
*H01R 12/70* (2011.01)

(58) Field of Classification Search
USPC ..... 439/607.18, 79, 82, 607.09, 607.32, 439/607.34, 607.35, 95
See application file for complete search history.

(56) References Cited

U.S. PATENT DOCUMENTS

| | | | | |
|---|---|---|---|---|
| 2013/0244494 | A1* | 9/2013 | Tziviskos ..... | H01R 13/405 439/676 |
| 2013/0330976 | A1 | 12/2013 | Simmel et al. | |
| 2014/0206209 | A1 | 7/2014 | Kamei et al. | |
| 2016/0240977 | A1 | 8/2016 | Huang et al. | |

FOREIGN PATENT DOCUMENTS

| | | |
|---|---|---|
| EP | 3151342 | 4/2017 |
| TW | 201722001 | 6/2017 |

* cited by examiner

INTERCONNECT DEVICES HAVING A BIPLANAR CONNECTION

CROSS-REFERENCE TO RELATED APPLICATION(S)

The present application claims the benefit of priority of U.S. Provisional Application No. 62/235,514 entitled "Interconnect Devices," filed on Sep. 30, 2015, the entire contents of which is hereby incorporated by reference.

FIELD

This disclosure relates to ports on computer devices. In particular, to systems and devices that connect these ports to internal components of the computer devices.

BACKGROUND

A typical computer will have one or more ports. These ports can include contact structures (e.g., male or female structures that include electrical contacts) that can be used, among other things, to connect to auxiliary devices, to provide power to auxiliary devices, to transfer data to and from the computer, and to connect to a network. Some ports may even support multiple functions (e.g., transfer data to and from an auxiliary device while also charging the auxiliary device). Recently, multi-use ports have been developed that can transfer large amounts of data at increasingly high speeds and also provide charging capabilities. This increased speed can result in increased signal noise and signal degradation as the data moves from a particular multi-use port to an internal component of the computer to be processed. Even as these ports are being developed, internal computer components and casings in which the computer components are held are becoming more compact. This can lead to stacking of internal components and ports in order to meet space requirements. Such stacking can increase signal noise picked up by adjacent components and can also add additional costs for assembly.

SUMMARY

Examples of the present disclosure are directed to interconnect devices that can be used to connect computer ports to a main logic board within a housing of a computer. A particular port (e.g., a Uniform Serial Bus (USB)) can be located in a first horizontal plane, while the main logic board can be located in a second horizontal plane that is different than the first. An interconnect device can be selected that forms a biplanar connection to connect the USB port and the main logic board. The interconnect device is designed to maintain high signal integrity and to efficiently utilize space within the housing.

In some examples, an interconnect device includes a printed circuit board disposed within a first plane and including a pin portion and a tongue portion having a plurality of electrical contacts forming a male tongue connector. The pin portion can include a plurality of pins configured to electrically couple with electrical contact locations on a main logic board located in a second plane. This can form an electrical connection between the plurality of electrical contacts and the main logic board.

In some examples, an interconnect device includes a rigid tongue portion including a male tongue connector located in a first plane and a rigid attachment portion located in a second plane. The interconnect device can also include a flexible portion that extends between the two rigid sections at the two different planes. The rigid attachment portion can include a plurality of contacts which can be attached to a main logic board. In this manner, the male tongue connector can be electrically coupled to the main logic board.

In some examples, an interconnect device includes a printed circuit board, a flexible circuit, and a connector. The printed circuit board can include a male tongue connector that, when installed, extends outside of a computer housing and is aligned in a first plane. A main logic board can be located within the housing and aligned in a second plane. The connector can connect the interconnect device to the main logic board, and the flexible circuit can flexibly extend between the two planes to connect the printed circuit board and the main logic board.

Examples of the present disclosure are also directed to integrated grounding systems. The integrated grounding systems can be used to ground a female connector plug that is connected to male tongue connector of a computer port. In some examples, two torsion springs are disposed within channels that have openings that extend into a port hole opening where the male tongue connector is located. As the female connector plug is connected to the male tongue connector, the two torsion springs come into contact with an outside surface of the female connector plug to form two grounding contacts. In some examples, a torsion spring is disposed within a single channel that has two openings that extend into a port hole opening on opposing sides. As the female connector plug is connected to the male tongue connector, opposing portions of the single torsion spring come into contact with the outside surface of the female connector plug to form two grounding contacts. In some examples, two telescoping contacts are disposed within two channels that have openings that extend into a port hole opening on opposing sides. As the female connector plug is connected to the male tongue connector, the telescoping contacts extend their ends into contact with the outside surface of the female connector plug to form two grounding contacts.

To better understand the nature and advantages of the present disclosure, reference should be made to the following description and the accompanying figures. It is to be understood, however, that each of the figures is provided for the purpose of illustration only and is not intended as a definition of the limits of the scope of the present disclosure. Also, as a general rule, and unless it is evident to the contrary from the description, where elements in different figures use identical reference numbers, the elements are generally either identical or at least similar in function or purpose.

BRIEF DESCRIPTION OF THE DRAWINGS

The disclosure will be readily understood by the following detailed description in conjunction with the accompanying drawings, in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Figure 1A:
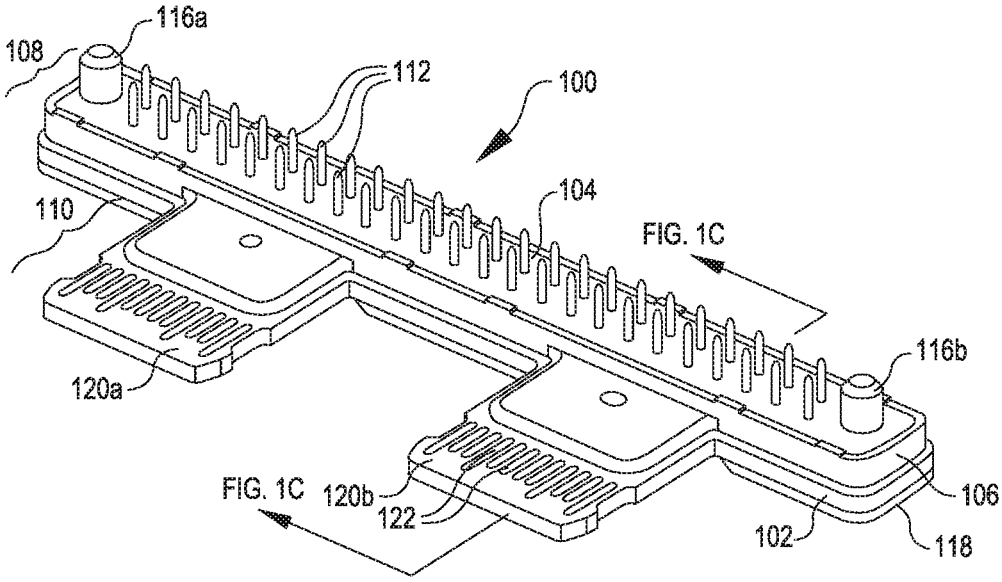
FIG. 1A shows a top isometric view of an interconnect device, in accordance with at least one example.
Figure 1B:
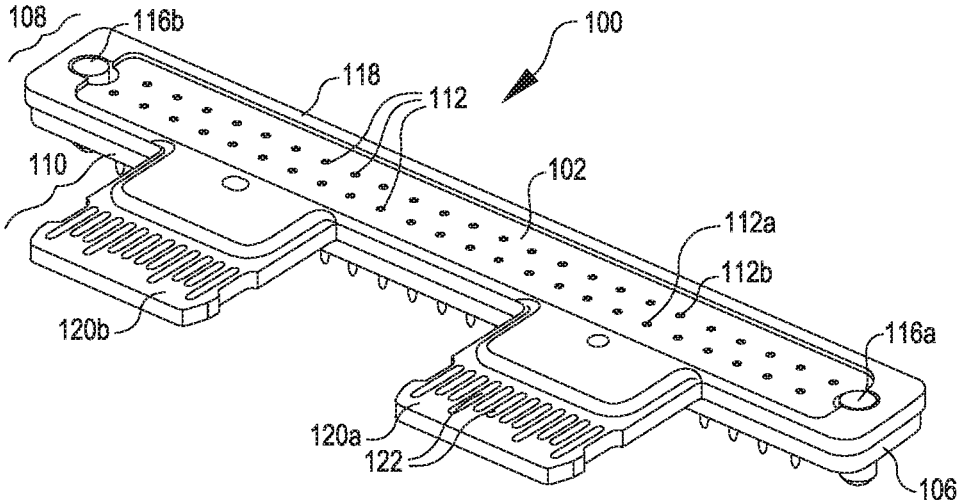
FIG. 1B shows a bottom isometric view of the interconnect device from FIG. 1A, in accordance with at least one example.

FIGS. 1A and 1B respectively illustrate a top view and a bottom view of an interconnect device 100, in accordance with at least one example of the disclosure. As described herein, the interconnect device 100 supports transfer of large amounts of data at high speeds to and from electronic devices. For example, certain aspects of the interconnect device 100 can be manufactured to comply with an existing USB specification (e.g., USB Type-C), which can be implemented in electronic devices. In some examples, these electronic devices include internal components and ports located at different horizontal planes relative to each other. For example, a USB port can be located in a first plane and a main logic board can be located in a second, different plane. The interconnect device 100 can be implemented to form a biplanar connection between the USB port and the main logic board. This biplanar connection can connect electrically (and in some examples, structurally) the USB port, which can also be included as part of the interconnect device 100, with the main logic board. Additionally, as the interconnect device 100 can be used to transfer large amounts of data at high speeds, the interconnect device 100 can achieve the biplanar connection in a manner that maintains consistent signal integrity and minimizes signal loss. For example, unlike other ports that typically include sheet metal shells surrounding their contact structures (e.g., male or female structures having electrical contacts), the interconnect device 100 (and the other interconnect devices described herein) can be grounded to a housing in which the interconnect device 100 is mounted via an integrated grounding system that excludes such a shell, as described herein. Additionally, the ability to mount the interconnect device 100 (and the other interconnect devices described herein) in the housing without the shell can provide a smoother and more aesthetically pleasing exterior presentation of the housing, while also maximizing space available in the housing as compared to mounting configurations of typical ports.

Turning now to the details of the interconnect device 100, the interconnect device 100 includes a printed circuit board 102, a pin support structure 104, a grounding shield 106, and a plurality of pins 112. The printed circuit board 102 can be any suitable multi-layered printed circuit board (PCB).

The printed circuit board 102 includes a pin portion 108 and a tongue portion 110. The pin portion 108 can be spaced apart from the tongue portion 110 and can include a plurality of pin contact locations. In some examples, a plurality of pins 112 are electrically connected to printed circuit board 102 at the plurality of pin contact locations within the pin portion 108 and thus, each of the pins 112 shown in FIGS. 1A and 1B also represents a pin contact location. Each individual pin in the plurality of pins 112 can have a substantially elongated shape and extend away from the printed circuit board 102 in a direction normal to the PCB 102. The cross-sectional profile of the plurality of pins 112 can be circular, rectangular, trapezoidal, or have any other shape. In some examples, each individual pin within the plurality of pins 112 can be dedicated to carrying power, ground, control, data, or other appropriate signals. In other examples, certain ones of the plurality of pins 112 can be reserved to provide redundancy in the event other pins 112 fail.

As described in more detail herein, the plurality of pins 112 can function as male conductive elements that can be mated with corresponding female conductive elements located within a main logic board 114. In some examples, the plurality of pins 112 can be manufactured from any suitable conductive material. For example, the plurality of pins 112 can be manufactured from copper or a copper alloy. The plurality of pins 112 is fixedly held in its position by the printed circuit board 102. In some examples, the plurality of pins 112 can be inserted into the printed circuit board 102 after the printed circuit board 102 has been formed.

In some examples, the pin support structure 104 also functions to retain the plurality of pins 112 in its position with respect to the printed circuit board 102. For example, the pin support structure 104 can include a plurality of pin openings through which the plurality of pins 112 can extend. The plurality of pins 112, when extended through the plurality of pin openings (not labeled but shown in FIGS. 1A and 1B at the locations at which the pins 112 extend out of pin support structure 104), can extend in a direction orthogonal to the tongue portion 110. The pin support structure 104 can be manufactured from any suitable insulative material such as, for example, plastic or ceramic, which can be electrically nonconductive. In some examples, the pin support structure 104 functions as a spacer. The pin support structure 104 can also include one or more alignment posts 116*a*, 116*b*. In some examples, the alignment posts 116*a*. 116*b* function to properly align the interconnect device 100 during installation (e.g., when being connected to the main logic board 114). In some examples, the alignment posts 116*a*, 116*b* function to retain other elements of the interconnect device 100. For example, as illustrated in FIG. 1B, the alignment posts 116*a*, 116*b* extend through the printed circuit board 102 and into groves formed in a second shield 118. In this manner, the alignment posts 116*a*, 116*b* and the pin support structure 104 can function to retain the second shield 118, the printed circuit board 102, the plurality of pins 112, and the grounding shield 106. In some examples, the grounding shield 106 can be grounded to the housing 126 via a grounding element 144. In some examples, the second shield 118 is attached to the interconnect device 100 and/or the main logic board 114 separate from the pin support structure 104. The grounding shield 106 can be configured to extend around the pin support structure 104.

As introduced above, the printed circuit board 102 also includes the tongue portion 110. The tongue portion 110 can include one or more tongues such as tongues 120*a*, 120*b* shown in FIGS. 1A and 1B. The tongues 120*a*, 120*b* can be part of connectors that enable other electronic devices, such as accessory devices, to be electrically connected to a computer in which the interconnect device 100 is implemented. While two tongues 120*a*, 120*b* are illustrated, it is understood that greater or fewer tongues, including a single tongue, can be included in the interconnect device 100. As described herein, each tongue 120*a*, 120*b* can include a plurality of electrical contacts 122 electrically connected to the plurality of pins 112.

In some examples, the tongues 120*a*, 120*b* extend orthogonally away from the plurality of pins 112. The plurality of contacts 122 can be disposed on opposing flat sides of the tongues 120*a*, 120*b*. Each conductive contact 122 functions to carry data, provide power, provide a ground return, carry control/configuration signals, or provide any other suitable function. The tongues 120*a*, 120*b* can be designed, including the designation of function for each of the contacts 122, and manufactured to comply with one or more standard connector plug types. For example, the tongues 120*a*, 120*b* can comply with a USB standard specification such as USB Type-C, USB 3.0, USB 2.0, or any other suitable standard. In some embodiments, the tongues 120*a*, 120*b* can be double-sided and capable of interfacing with a reversible-connector plug for USB devices.

Figure 1C:
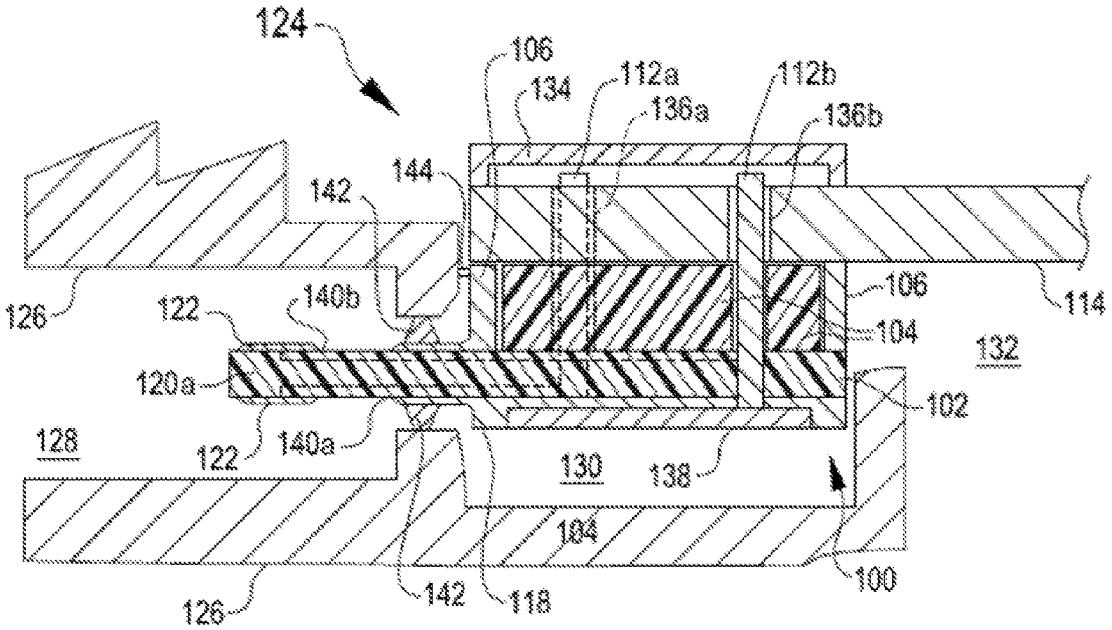
FIG. 1C shows a profile view of an interconnect system including the interconnect device from FIG. 1A and a main logic board, in accordance with at least one example.

FIG. 1C illustrates a profile view of an interconnect system 124 including the interconnect device 100 after the interconnect device 100 has been connected to the main logic board 114, in accordance with at least one example of the disclosure. The main logic board 114 can be any suitable multi-layer printed circuit board (e.g., a motherboard). In some examples, the main logic board 114 can provide structural support to the interconnect device 100.

In addition to the interconnect device 100 and the main logic board 114, the interconnect system 124 also includes housing 126. The housing 126 can be a body of an electronic device to which the interconnect device 100 and the main logic board 114 are attached. In this manner, the housing 126 can be considered a chassis, which, in some examples, is formed from a single piece of material, i.e., is a unibody chassis. The housing 126, whether defined as unibody or otherwise, can be formed from any suitable rigid material such as polycarbonate, fiberglass, aluminum, or any other suitable material.

The housing 126 can include a port hole opening 128, an intermediate cavity 130, and a main cavity 132. In some examples, the tongue 120*a* of the interconnect device 100 extends within the port hole opening 128 such that a corresponding connector plug can interface with the tongue 120*a*. The plurality of pins 112 of the interconnect device 100 can be disposed within the intermediate cavity 130. In some examples, the intermediate cavity 130 is the location within the housing 126 where the printed circuit board 102 that is aligned in a first plane is connected via the plurality of pins 112 with the main logic board 114 aligned in a second, different plane. In other words, the biplanar connection can take place within the intermediate cavity 130. In other examples, the biplanar connection takes place in the main cavity 132. In some examples, the first plane and the second plane are substantially parallel. The main cavity 132 is the location where the main logic board 114 and other computer components (e.g., memory, hard drives, chips, etc.) are located, some of which can be attached to the housing 126 and/or the main logic board 114.

As illustrated in FIG. 1C, the pins 112*a* and 112*b*, at least those dedicated to ground, can extend from the second shield 118 via the printed circuit board 102, the pin support structure 104, and the main logic board 114, to a first grounding shield 134. In some examples, the pins 112*a* and 112*b* terminate within the main logic board 114. The main logic board 114 can include a plurality of electro-plated holes 136 which align with the plurality of pins 112. The plurality of electro-plated holes 136 can be electrically coupled to the plurality of pins 112 to form a coupled structure. In some examples, the plurality of electro-plated holes 136 can be structurally coupled to the plurality of pins 112 to form the coupled structure. The coupled structure can function to provide structural support to the printed circuit board 102 and to align the tongues 120*a*, 120*b* within the port hole opening 128. Thus, the plurality of pins 112 can provide electrical connections with the main logic board 114 and structural connections. In some examples, as illustrated in FIG. 1C with respect to the pin 112*b* and the hole 136*b*, the plurality of pins 112 can be soldered to the main logic board 114 after they are inserted into the main logic board 114.

In some examples, at least some of the plurality of pins 112 can be electrically coupled to the second shield 118 via an inlay 138 or otherwise. The inlay 138 can be applied using a soldering technique in which the area inside within the second shield 118 is filled in. In other examples, at least some of the plurality of electrical contacts 122 are electrically coupled to the second shield 118.

The pins 112*a* and 112*b* are each connected to a particular conductive contact 122 via respective electrical traces 140*a* and 140*b* embedded within the printed circuit board 102. The other pins 112 can be connected to other electrical contacts 122 via other electrical traces. While illustrated as being in different layers, in some examples, all of the electrical traces are within the same layer. The interconnect system 124 can also include one or more gaskets 142. The one or more gaskets 142 can function as a contaminant barrier between the intermediate cavity 130 and the port hole opening 128. In some examples, the one or more gaskets 142 can also provide structural support to the tongue 120*a*.

As the tongues 120*a*, 120*b* can be configured to mate with corresponding connector plugs (e.g., accessory devices), the biplanar connection between the interconnect device 100 and the main logic board 114 can be capable of withstanding opposing mating forces exerted on the tongues 120*a*, 120*b* when the connector plugs are connected to the tongues 120*a*, 120*b*.

Figure 2A:
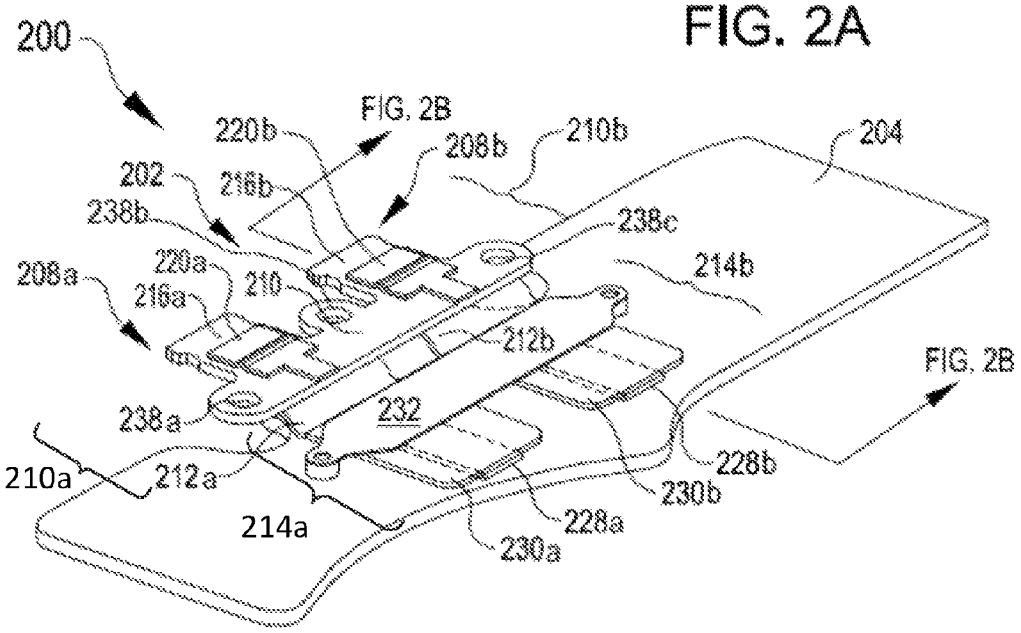
FIG. 2A shows a bottom isometric view of an interconnect system including an interconnect device and a main logic board, in accordance with at least one example.
Figure 2B:
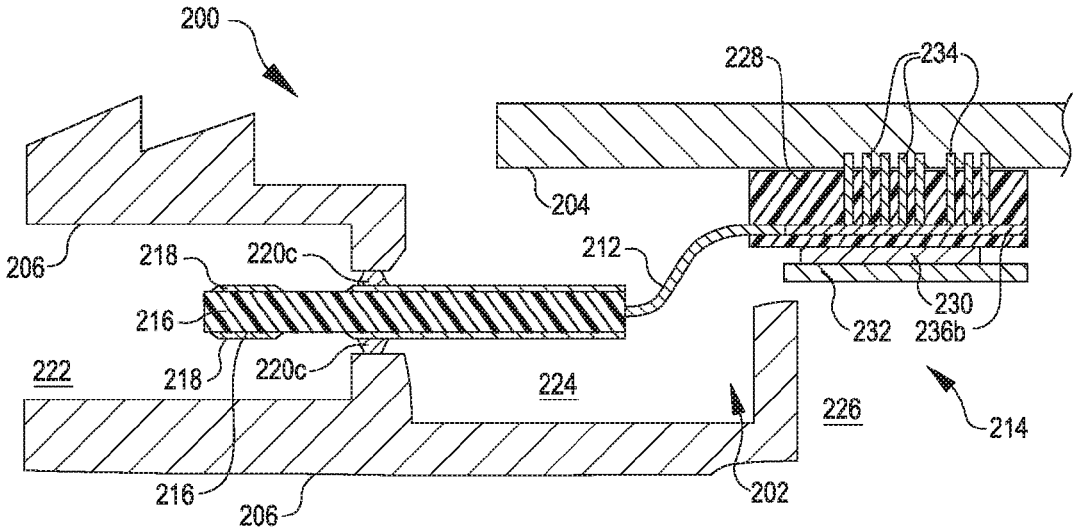
FIG. 2B shows a profile view of the interconnect system from FIG. 2A, in accordance with at least one example.

FIGS. 2A and 2B respectively illustrate a bottom isometric view and a profile view of an interconnect system 200 including a rigid-flex interconnect device 202, in accordance with at least one example of the disclosure. Like the interconnect device 100 described herein, the rigid-flex interconnect device 202 supports transfer of large amounts of data at high speeds to and from electronic devices. For example, certain aspects of the rigid-flex interconnect device 202 can be manufactured to comply with an existing specification (e.g., USB Type-C), which can be implemented in electronic devices. In some examples, these electronic devices include internal components and ports located in different horizontal planes relative to each other. For example, a USB port attached to the rigid-flex interconnect device 202 can be located in a first plane and a main logic board 204 can be located in a second, different plane. The rigid-flex interconnect device 202 can be implemented to form a biplanar connection between the USB port and the main logic board 204. This biplanar connection can connect electrically (and in some examples, structurally) the USB port, which can also be included as part of the rigid-flex interconnect device 202, with the main logic board 204. Additionally, as the rigid-flex interconnect device 202 can be used to transfer large amounts of data at high speeds, the rigid-flex interconnect device 202 can achieve the biplanar connection in a manner that maintains consistent signal integrity and minimizes signal loss.

As introduced above, the interconnect system 200 includes the rigid-flex interconnect device 202 attached to the main logic board 204. The main logic board 204 is an example of the main logic board 114. In some examples, the interconnect system 200 also includes a housing 206. The housing 206 is an example of the housing 126.

The rigid-flex interconnect device 202 includes one or more rigid-flex circuit boards 208*a*. 208*b*. The rigid-flex circuit boards 208*a*, 208*b* can be printed circuit boards that are manufactured using any suitable manufacturing process that forms multiple metal signal layers. In some examples, each rigid-flex circuit board 208*a*, 208*b* also includes one or more layers of flexible material. The printed circuit boards can be laminated to the one or more layers of flexible material. In this manner, the rigid-flex circuit boards 208*a*, 208*b* can include flexible and rigid properties. In some examples, portions of the flexible material also include metal signal layers.

The rigid-flex circuit board 208*a*, 208*b* includes a rigid tongue portion 210*a*, 210*b*, a flexible intermediate portion 212*a*, 212*b*, and a rigid attachment portion 214*a*, 214*b*. The rigid tongue portion 210*a*, 210*b* can be located in a first plane and can include a tongue 216*a*, 216*b* and a plurality of electrical contacts 218. The tongue 216*a*, 216*b* is an example of the tongues 120*a*, 120*b*. The plurality of electrical contacts 218 are examples of the plurality of electrical contacts 122. The rigid tongue portion 210 can be formed from a rigid portion of the rigid-flex circuit board 208*a*, 208*b*.

The rigid tongue portion 210*a*, 210*b* can also include a mounting structure, which can include one or more mounting locations 238*a*, 238*b*, 238*c* and one or more mounting gaskets 220*a*, 220*b*. The one or more mounting locations 238*a*, 238*b*, 238*c* can be used to securely hold the rigid tongue portion 210*a*, 210*b* within the port hole opening 222. For example, the one or more mounting locations 238*a*, 238*b*, 238*c* can be one or more holes, and one or more screws, bolts, rivets, or other fasteners can be inserted through the one or more holes and attached to the housing 206. In this manner, the rigid tongue portion 210*a*, 210*b* can be securely held by the housing 206. In some examples, the one or more mounting locations 238*a*, 238*b*, 238*c* also function to appropriately position the tongue 216*a*, 216*b* of the rigid tongue portion 210*a*, 210*b* in the port hole opening 222. As the tongue 216*a*, 216*b* *can be configured to mate with a corresponding connector plug, the one or more mounting* locations 238*a*, 238*b*, 238*c* can be capable of withstanding an opposing mating force exerted on the tongue 216*a*, 216*b* when the connector plug mates with the tongue 216*a*, 216*b*.

The mounting gaskets 220*a*, 220*b* can be attached to the rigid tongue portion 210*a*, 210*b* and can function as a contaminant barrier between the intermediate cavity 224 and the port hole opening 222. In some examples, the mounting gaskets 220*a*, 220*b* can also be configured to retain the rigid tongue portion 210*a*, 210*b* within the port hole opening 222 of the housing 206. In some examples, use of the mounting gaskets 220*a*, 220*b* and/or other comparable structure may be desirable in order to ensure that the rigid-flex interconnect device 202 remains stably held within the housing 206. In some examples, the rigid tongue portion 210*a*, 210*b* extends from the port hole opening 222 to an intermediate cavity 224 of the housing 206.

Within the intermediate cavity 224, the rigid tongue portion 210*a*, 210*b*, located in the first plane, begins to transition to the flexible intermediate portion 212*a*, 212*b*. The flexible intermediate portion 212*a*, 212*b* extends from the rigid tongue portion 210*a*, 210*b* to the rigid attachment portion 214*a*, 214*b*. In some examples, the flexible intermediate portion 212*a*, 212*b* may be formed from any suitable flexible material capable of carrying electrical signals between the electrical contacts 218 and the main logic board 204. In some examples, the flexible intermediate portion 212*a*, 212*b* includes continuous signal traces for the rigid-flex interconnect device 202. In this example, the flexible intermediate portion 212*a*, 212*b* can extend from the rigid tongue portion 210*a*, 210*b* to the rigid attachment portion 214*a*, 214*b* and can be embedded within each of the rigid tongue portion 210*a*, 210*b* and the rigid attachment portion 214*a*, 214*b*.

The rigid attachment portion 214*a*, 214*b* can be located in a second plane above or below the first plane and at least partially disposed within a main cavity 226. In some examples, the rigid attachment portion 214*a*, 214*b* includes a connector 228*a*, 228*b*, a insulative gasket 230*a*, 230*b*, and a retention plate 232. The connector 228*a*, 228*b* can include a second plurality of electrical contacts 234 in electrical communication with an attachment board 236. In some examples, the attachment board 236 is in electrical communication with the flexible intermediate portion 212*a*, 212*b* and can be a printed circuit board. The attachment board 236 can be connected to the main logic board via the connector 228*a*, 228*b*. In some examples, the connector 228*a*, 228*b* functions as a device that enables a board-to-board connection between the attachment board 236 and the main logic board 204. In some examples, the main logic board 204 includes a plurality of electro-plated holes in which the second plurality of electrical contacts 234 can be inserted. The second plurality of electrical contacts 234 can be in electrical communication with the attachment board 236. In some examples, the second plurality of electrical contacts 234 is included as part of the connector 228*a*, 228*b*.

The insulative gasket 230*a*, 230*b* is disposed between the retention plate 232 and the connector 228*b*. In some examples, the insulative gasket 230*a*, 230*b* functions to electrically isolate the retention plate 232 and the attachment board 236. The retention plate 232 can be formed from a rigid material and can be attached to the main logic board 204. The retention plate 232 can function to ensure that the attachment board 236 remains connected to the main logic board 204.

Figure 3:
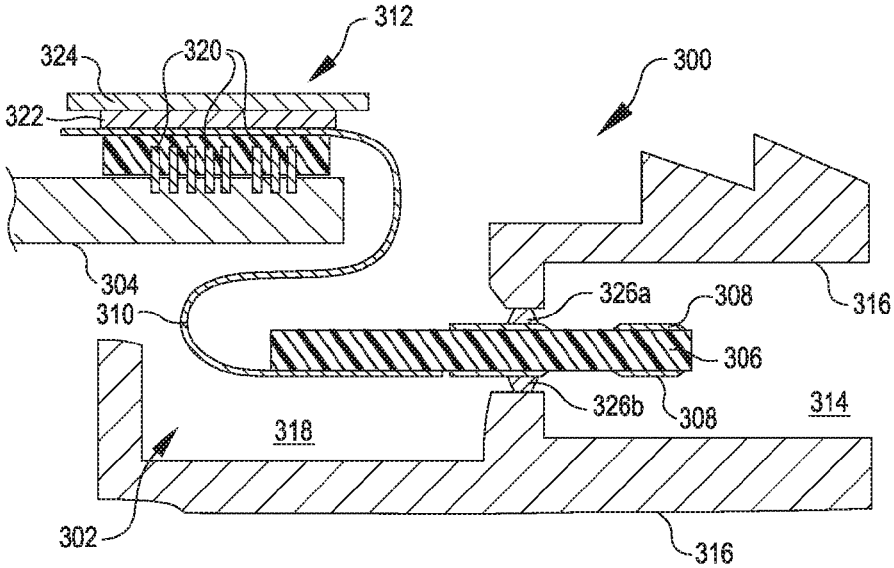
FIG. 3 shows a profile view of an interconnect system, in accordance with at least one example.

FIG. 3 illustrates a profile view of an interconnect system 300, in accordance with at least one example of the disclosure. The interconnect system 300 includes a flexible interconnect device 302 that can be used to form a biplanar connection between the main logic board 304 and a tongue 306 or connector that has the shape of a tongue. Like the interconnect devices 100 and 202 described herein, the flexible interconnect device 302 supports transfer of large amounts of data at high speeds to and from electronic devices. For example, certain aspects of the flexible interconnect device 302 can be manufactured to comply with an existing specification (e.g., USB Type-C), which can be implemented in electronic devices. In some examples, these electronic devices include internal components and ports located in different horizontal planes relative to each other. For example, a USB port attached to the flexible interconnect device 302 can be located in a first plane and the main logic board 304 can be located in a second, different plane. The flexible interconnect device 302 can be implemented to form a biplanar connection between the USB port and the main logic board 304. This biplanar connection can connect electrically (and in some examples, structurally) the USB port, which can also be included as part of the flexible interconnect device 302, with the main logic board 304. Additionally, as the flexible interconnect device 302 can be used to transfer large amounts of data at high speeds, the flexible interconnect device 302 can achieve the biplanar connection in a manner that maintains consistent signal integrity and minimizes signal loss.

The flexible interconnect device 302 includes the tongue 306, which can be a printed circuit board with exposed contacts 308, a flexible circuit 310, and a connector structure 312. The tongue 306 is located in a first plane and extends from an intermediate cavity 318 into a port hole opening 314 of a housing 316. The connector structure 312 is located in a second plane. The flexible circuit 310 functions to flexibly connect the connector structure 312 and the tongue 306 (i.e., the exposed contacts 308). The flexible circuit 310 can be formed by laminating a printed circuit onto a flexible material. The flexible circuit 310 can be attached to the tongue 306 and the connector structure 312 using any suitable techniques.

The connector structure 312 functions to connect the flexible circuit 310 to the main logic board 304. In some examples, the connector structure 312 is any suitable device that enables a connection between a flexible printed circuit and the main logic board 304. In some examples, the connector structure 312 functions as a device that enables a board-to-board connection between the main logic board 304 and the flexible interconnect device 302. In some examples, the connector structure 312 includes a plurality of electrical contacts 320 which correspond to the exposed contacts 308. The plurality of electrical contacts 320 can be inserted into corresponding electro-plated holes in the main logic board 304. The connector structure 312 also includes an insulative gasket 322 and a retention plate 324.

The interconnect device 302 can also include one or more mounting gaskets 326*a*, 326*b*. The mounting gaskets 326*a*, 326*b* can be attached to the tongue 306 and configured to retain the tongue 306 within the port hole opening 314. In some examples, use of the mounting gaskets 326*a*, 326*b* and/or other comparable structure may be desirable in order to ensure that the interconnect device 302 remains stably held within the housing 316. In some examples, the interconnect device 302 can also include a mounting structure, which can include one or more mounting locations. The one or more mounting locations can be used to securely hold the tongue 306 within the port hole opening 314. For example, the one or more mounting locations can be one or more holes, and one or more screws, bolts, rivets, or other fasteners can be inserted through the one or more holes and attached to the housing 316. In this manner, the tongue 306 can be securely held by the housing 316. In some examples, the one or more mounting locations also function to appropriately position the tongue 306 in the port hole opening 314. As the tongue 306 can be configured to mate with a corresponding connector plug, the one or more mounting locations can be capable of withstanding an opposing mating force exerted on the tongue 306 when the connector plug mates with the tongue 306.

Figure 4:
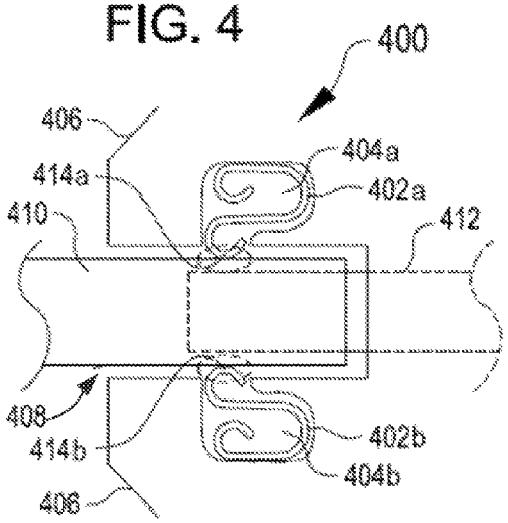
FIG. 4 shows an integrated grounding system including two springs, in accordance with at least one example.
Figure 5:
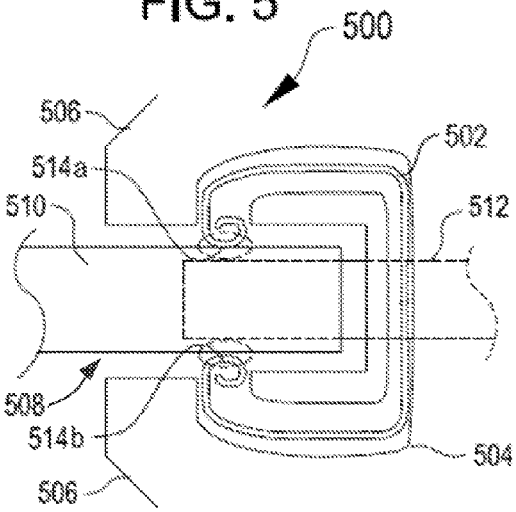
FIG. 5 shows an integrated grounding system including one spring, in accordance with at least one example.
Figure 6:
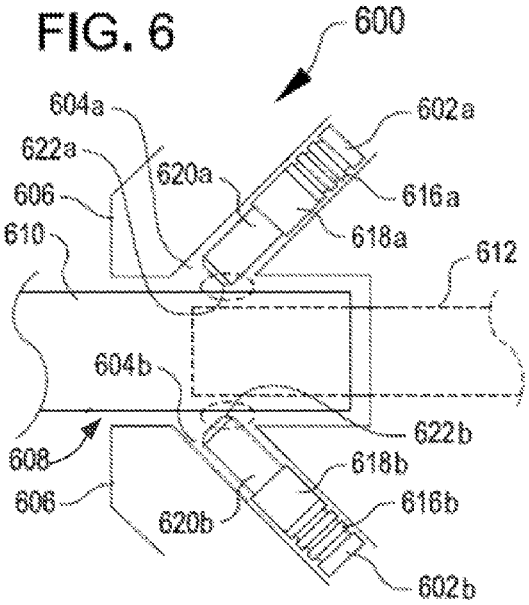
FIG. 6 shows an integrated grounding system including two telescoping contacts, in accordance with at least one example.

As described herein, the interconnect devices can be disposed within housings of electronic devices. These electronic devices can be connected to other electronic devices via tongues of the interconnect devices. In particular, connector plugs of the other electronic devices can mate with the tongues to create electrical connections by which, among other things, data and power may be transferred between the devices. In some examples, in order for proper formation of the electrical connections, grounding connections between the connector plugs and the housings may also be required. In some examples, these grounding connections can be achieved through incidental contact between connector plugs and the housings. In an illustrative example, a tip of a plug connector can be inserted over a tongue and contact a portion of a housing that surrounds the tongue. When the housing is formed from a conductive material, such contact may create a suitable grounding connection, even in the absence of a shell that typically surrounds a tongue. In some examples, grounding systems may nevertheless be desirable to ensure that suitable grounding connections are provided and to reduce signal noise during data transfer. FIGS. 4-6 illustrate examples of grounding systems that can be integrated into housings of electronic devices to create such suitable grounding connections.

FIG. 4 illustrates a top, cut-away view of an integrated grounding system 400, in accordance with at least one example of the disclosure. The integrated grounding system 400 can include two or more springs 402*a*, 402*b* retained within spring channels 404*a*, 404*b* of a housing 406. The housing 406 is an example of the housings 126, 206, and 316 described herein. Thus, the housing 406 can include a port hole opening 408 into which a connector plug 410 can be inserted. The connector plug 410 can be any suitable connector plug such as one constructed in accordance with any standard specification, including those described herein. The connector plug 410 is inserted into the port hole opening 408 in order to connect with a corresponding tongue 412. The tongue 412 is an example of the tongues 120*a*, 120*b*, 216*a*, 216*b*, and 306 and is configured to interface with the connector plug 410.

The spring channels 404*a*, 404*b* can be sized to accommodate the springs 402*a*, 402*b* and can include locations at which the springs 402*a*, 402*b* can be grounded to the housing 406. The springs 402*a*, 402*b* can be any suitable torsion springs that can function to electrically ground the connector plug 410 when it connects with the tongue 412. In some examples, the springs 402*a*, 402*b* extend out of the spring channels 404*a*, 404*b* and into the port hole opening 408. In practice, as the connector plug 410 is inserted into the port hole opening 408, the exterior surface of the connector plug 410 contacts the springs 402*a*, 402*b* and causes the springs 402*a*, 402*b* to begin to engage with the exterior surface. When the connector plug 410 is connected to the tongue 412, the springs 402*a*, 402*b* remain engaged with the exterior surface of the connector plug 410 at grounding points 414*a*, 414*b*. This engagement provides a grounding connection between the connector plug 410 and the housing 406.

FIG. 5 illustrates a top, cut-away view of an integrated grounding system 500 in accordance with at least one example of the disclosure. The integrated grounding system 500 can include a single spring 502 retained within a spring channel 504 of a housing 506. The housing 506 is an example of the housings 126, 206, 316, and 406 described herein. Thus, the housing 506 can include a port hole opening 508 into which a connector plug 510 can be inserted. The connector plug 510 can be any suitable connector plug such as one constructed in accordance with any standard specification, including those described herein. The connector plug 510 is inserted into the port hole opening 508 in order to connect with a corresponding tongue 512. The tongue 512 is an example of the tongues 120*a*, 120*b*, 216*a*, 216*b*, 306, and 412 and is configured to interface with the connector plug 510.

The spring channel 504 can be sized to accommodate the spring 502 and can include locations at which the spring 502 can be grounded to the housing 506. The spring 502 can be any suitable torsion spring that can function to electrically ground the connector plug 510 when it connects with the tongue 512. In some examples, portions of the spring 502 can extend out of the spring channel 504 and into the port hole opening 508. In practice, as the connector plug 510 is inserted into the port hole opening 508, the exterior surface of the connector plug 510 contacts the spring 502 and causes the spring 502 to begin to engage with the exterior surface. When the connector plug 510 is connected to the tongue 512, the spring 502 remains engaged with the exterior surface of the connector plug 510 at grounding points 514*a*, 514*b*. This engagement provides a grounding connection between the connector plug 510 and the housing 506.

FIG. 6 illustrates a top, cut-away view of an integrated grounding system 600 in accordance with at least one example of the disclosure. The integrated grounding system 600 can include one or more telescoping contacts 602*a*, 602*b* retained within channels 604*a*, 604*b* of a housing 606. The housing 606 is an example of the housings 126, 206, 316, 406, and 506 described herein. Thus, the housing 606 can include a port hole opening 608 into which a connector plug 610 can be inserted. The connector plug 610 can be any suitable connector plug such as one constructed in accordance with any standard specification, including those described herein. The connector plug 610 is inserted into the port hole opening 608 in order to connect with a corresponding tongue 612. The tongue 612 is an example of the tongues 120*a*, 120*b*, 216*a*, 216*b*, 306, 412, and 512 and is configured to interface with the connector plug 610.

The telescoping contacts 602*a*, 602*b* can include threads 616*a*, 616*b*, spring cylinders 618*a*, 618*b*, and contacts 620*a*, 620*b*. The threads 616*a*, 616*b* function to hold the telescoping contacts 602*a*, 602*b* within the channels 604*a*, 604*b* and also to form a grounding contact with the housing 606. The spring cylinders 618*a*, 618*b* retain one or more helical springs that function to force the contacts 620*a*, 620*b* in a direction away from the threads 616*a*, 616*b*. The one or more helical springs cause the contacts 620*a*, 620*b* to engage with an exterior surface of the connector plug 610. In some examples, the telescoping contacts 602*a*, 602*b* are examples of pogo pins.

The channels 604*a*, 604*b* can be sized to accommodate the telescoping contacts 602*a*, 602*b*. For example, the channels 604*a*, 604*b* can be sized slightly narrower than the outside diameter of the threads 616*a*, 616*b* such that the threads 616*a*, 616*b* can engage with interior surfaces of the channels 604*a*, 604*b*. In some examples, the channels 604*a*, 604*b* are tapped prior to insertion of the telescoping contacts 602*a*, 602*b*. In other examples, the spring cylinders 618*a*, 618*b* are pressed into the channels 604*a*, 604*b* and held via an interference fit (e.g., without use of the threads 616*a*, 616*b*).

End portions of the contacts 620*a*, 620*b* extend out of the channels 604*a*, 604*b* and into the port hole opening 608. In practice, as the connector plug 610 is inserted into the port hole opening 608, the exterior surface of the connector plug 610 contacts the end portions of the contacts 620*a*, 620*b* and causes the end portions to begin to engage with the exterior surface. When the connector plug 610 is connected to the tongue 612 (i.e., after it has been fully inserted), the one or more helical springs in the spring cylinders 618*a*, 618*b* are compressed, which causes the end portions of the contacts 620*a*, 620*b* to remain engaged with the exterior surface of the connector plug 610 at grounding points 622*a*, 622*b*. This engagement provides a grounding connection between the connector plug 610 and the housing 606.

In some examples, the grounding points of the integrated grounding system 600 (and the other integrated grounding systems described herein) are positioned towards the outside of the housings. This can, in some examples, lead to noise reduction, even during high speed transfers via the connector plugs.

Spatially relative terms, such as "below", "above", "lower", "upper" and the like may be used above to describe an element and/or feature's relationship to another element(s) and/or feature(s) as, for example, illustrated in the figures. It will be understood that the spatially relative terms are intended to encompass different orientations of the device in use and/or operation in addition to the orientation depicted in the figures. For example, if the device in the figures is turned over, elements described as "below" and/or "beneath" other elements or features would then be oriented "above" the other elements or features. The device may be otherwise oriented (e.g., rotated 90 degrees or at other orientations) and the spatially relative descriptors used herein interpreted accordingly.

The above description of embodiments of the disclosure has been presented for the purposes of illustration and description. It is not intended to be exhaustive or to limit the disclosure to the precise form described, and many modifications and variations are possible in light of the teaching above. The embodiments were chosen and described in order to best explain the principles of the disclosure and its practical applications to thereby enable others skilled in the art to best utilize the disclosure in various embodiments and with various modifications as are suited to the particular use contemplated. Thus, it will be appreciated that the disclosure is intended to cover all modifications and equivalents within the scope of the following claim.

What is claimed is:

1. An interconnect device for an electronic device, the interconnect device comprising:

a printed circuit board comprising:

a tongue portion supporting a plurality of electrical contacts;

a pin portion spaced apart from the tongue portion and including a plurality of pin contact locations; and a plurality of electrical traces extending between the tongue portion and the pin portion, wherein individual electrical traces in of the plurality of electrical traces electrically connect individual electrical contacts in the plurality of electrical contacts to individual contact locations in the plurality of pin contact locations;

a pin support structure attached to the printed circuit board and disposed adjacent to the pin portion, the pin support structure comprising an electrically nonconductive material having a plurality of pin openings formed therethrough;

a plurality of elongated pins electrically coupled to the printed circuit board at the plurality of pin contact locations, each of the plurality of elongated pins extending through a pin opening in the plurality of pin openings in the pin support structure; and a grounding shield attached to the printed circuit board and extending around the pin support structure.

2. The interconnect device of claim 1, wherein the tongue portion is a first tongue portion and the electrical contacts are first electrical contacts, the printed circuit board further comprising a second tongue portion supporting second electrical contacts, the electrical traces extending between the second tongue portion and the pin portion and electrically connecting the second electrical contacts to the pin contact locations.

3. The interconnect device of claim 1, further comprising a gasket disposed about the tongue portion and configured to extend away from the tongue portion and contact a housing of the electronic device when the interconnect device is mounted in the housing.

4. The interconnect device of claim 1, wherein the tongue portion and the plurality of electrical contacts of the tongue portion are dimensioned to correspond to a Uniform Serial Bus (USB) Type-C specification.

5. The interconnect device of claim 1, wherein the plurality of electrical contacts comprise first electrical contacts disposed on a first side of the tongue portion and second electrical contacts disposed on a second side of the tongue portion.

6. The interconnect device of claim 1, wherein the plurality of elongated pins are configured to couple with corresponding conductive holes of a main logic board to form a coupled structure between the printed circuit board and the main logic board.

7. The interconnect device of claim 6, wherein:

the coupled structure functions to position the tongue portion in a port hole opening of a housing of the electronic device; and the main logic board and at least a portion of the interconnect device are disposed within the housing.

8. The interconnect device of claim 1, wherein the electronic device comprises a main logic board aligned in a second plane spaced apart from a first plane aligned with the printed circuit board, the main logic board comprising conductive holes, wherein at least some of the conductive holes align with and are electrically coupled to the plurality of elongated pins.

9. The interconnect device of claim 1, wherein the printed circuit board comprises a rigid-flex structure including a rigid tongue portion and a rigid pin portion coupled together with a flexible intermediate portion that supports the plurality of electrical traces extending between the tongue portion and the pin portion.

10. The interconnect device of claim 9, wherein the flexible intermediate portion enables the tongue portion and the pin portion to be positioned in different planes.

11. The interconnect device of claim 9, further comprising a gasket disposed on the tongue portion and configured to extend away from the tongue portion and contact a housing of the electronic device when the interconnect device is mounted in the housing.

12. An electronic device, comprising:

a printed circuit board aligned in a first plane, the printed circuit board comprising:

a tongue portion comprising electrical contacts;

a pin portion spaced apart from the tongue portion and comprising pin contact locations; and electrical traces extending between the tongue portion and the pin portion, wherein individual electrical traces in the electrical traces electrically connect individual electrical contacts in the electrical contacts to individual pin contact locations;

a pin support structure attached to the printed circuit board and disposed adjacent to the pin portion, the pin support structure comprising an electrically nonconductive material having pin openings formed therethrough;

elongated pins electrically coupled to the printed circuit board at the pin contact locations, individual elongated pins of the elongated pins extending through the pin openings in the pin support structure; and a main logic board aligned in a second plane spaced apart from the first plane, the main logic board comprising conductive holes, wherein at least some of the conductive holes align with and are electrically coupled to the elongated pins.

13. The electronic device of claim 12, further comprising a housing, and wherein at least a portion of the printed circuit board is disposed within the housing.

14. The electronic device of claim 13, wherein:

the conductive holes structurally couple with the elongated pins to form a coupled structure between the printed circuit board and the main logic board; and the coupled structure positions the tongue portion in a port hole opening of the housing.

15. The electronic device of claim 13, further comprising a grounding system disposed within one or more channels of the housing of the electronic device, at least a portion of the grounding system extending into a port hole opening of the housing via one or more channel openings.

16. The electronic device of claim 15, wherein the grounding system comprises one or more springs configured to engage with a connector plug of an accessory device at one or more contact locations on an exterior surface of the connector plug when the connector plug is connected to the tongue portion.

17. The electronic device of claim 15, wherein the grounding system comprises one or more telescoping contacts configured to engage with a connector plug of an accessory device at one or more contact locations on an exterior surface of the connector plug when the connector plug is connected to the tongue portion.

18. The electronic device of claim 12, further comprising a grounding shield attached to the printed circuit board and extending around the pin support structure.

19. The electronic device of claim 12, wherein the printed circuit board comprises a rigid-flex structure including a rigid tongue portion and a rigid pin portion coupled together with a flexible intermediate portion that supports the electrical traces extending between the tongue portion and the pin portion.

20. The electronic device of claim 19, wherein the flexible intermediate portion enables the tongue portion and the pin portion to be positioned in different planes.

21. The electronic device of claim 19, further comprising a gasket disposed on the tongue portion and configured to extend away from the tongue portion and contact a housing of the electronic device when the interconnect device is mounted in the housing.

* * * * *